US009199257B2

(12) United States Patent
Wang

(10) Patent No.: US 9,199,257 B2
(45) Date of Patent: Dec. 1, 2015

(54) PRESS TYPE SPRAY HEAD ASSEMBLY

(71) Applicant: Ya-Tsan Wang, HsinChu (TW)

(72) Inventor: Ya-Tsan Wang, HsinChu (TW)

(73) Assignee: Derjin (Hong Kong) Holding Company Limited, Central (HK)

( * ) Notice: Subject to any disclaimer, the term of this patent is extended or adjusted under 35 U.S.C. 154(b) by 114 days.

(21) Appl. No.: 14/198,593

(22) Filed: Mar. 6, 2014

(65) Prior Publication Data

US 2015/0251203 A1 Sep. 10, 2015

(51) Int. Cl.
*B05B 11/00* (2006.01)

(52) U.S. Cl.
CPC ..... *B05B 11/3001* (2013.01); *B05B 11/3047* (2013.01); *B05B 11/3059* (2013.01)

(58) Field of Classification Search
CPC ..... B05B 11/3001; B05B 11/3047; B05B 11/3059
USPC ..... 222/321.1, 321.6–321.9, 383.1, 383.3, 222/153.13
See application file for complete search history.

(56) References Cited

U.S. PATENT DOCUMENTS 5,518,147 A * 5/1996 Peterson ..... B05B 11/3035 222/153.07
6,695,176 B1 * 2/2004 Nazari ..... B05B 11/007 222/321.9
8,827,121 B2 * 9/2014 Law ..... B05B 11/0018 222/153.13
2009/0314805 A1 * 12/2009 Ding ..... B05B 11/306 222/153.13
2010/0006604 A1 * 1/2010 Ding ..... B05B 11/007 222/320

* cited by examiner

*Primary Examiner* — Donnell Long
(74) *Attorney, Agent, or Firm* — C. G. Mersereau; Nikolai & Mersereau, P.A.

(57) ABSTRACT

A spray head assembly includes a tubular cylinder having a separation board transversely connected therein and a through hole is defined centrally through the separation board. A space is defined in the cylinder and communicates with the through hole. A check valve is located in the space and has a check rod which extends through the through hole. A piston rod is located in the cylinder and a spring is mounted to the piston rod. A cover is connected to the cylinder and a locking member. The piston rod extends through the locking member. A push tube extends through the locking member and communicates with the cylinder. A movable member is located in the push tube which is connected to a press head. A nozzle extends outward from the press head. The spray head is water-proof and the amount liquid remained in the nozzle can be sucked back after use.

15 Claims, 12 Drawing Sheets

PRESS TYPE SPRAY HEAD ASSEMBLY

BACKGROUND OF THE INVENTION (1) Fields of the Invention

The present invention relates to a spray head assembly, and more particularly, to a press type spray head assembly with a pneumatic head unit installed to the opening of the bottle.

(2) Descriptions of Related Art

The conventional spray head assemblies generally comprise a head which is pressed downward to generate pressure to suck the liquid in the bottle up and the liquid is obtained from the nozzle at specific amount. The type of spray head assemblies are widely used on shampoo, lotion, kitchen and bath-room cleaning liquid.

A typical conventional spray head assembly 200 is shown in FIG. 1. In order to prevent the press head 201 from unintentionally pushed to leak the liquid, the press head 201 is set to be in a pushed status and tightly fitted with the bottle 202. The pushed status allows the path 204 of the movable member 203 in the spray head assembly 200 is opened so that the liquid in the bottle 202 may leak during transportation via the path 204.

Besides, the conventional spray head assemblies usually are not water-proof, which means that water may enter into the bottle to contaminate the liquid in the bottle. Furthermore, after the spread head is pushed and released, some of the liquid is remained in the nozzle, and the small amount of liquid will evenly drop to the rack or floor due to gravity.

The present invention intends to provide a spray head assembly which is designed to improve the shortcomings mentioned above.

SUMMARY OF THE INVENTION

The present invention relates to a spray head assembly and comprises a tubular cylinder with a separation board transversely connected therein. The separation board has a through hole. A space is defined in the cylinder and communicates with the through hole. A check valve is located in the space and an inlet path is formed along the periphery of the space. The check valve has a cap and a check rod, wherein the cap is movably connected to the inlet path which is opened and closed when the cap is moved up and down. The check rod extends through the through hole. A piston rod is a hollow rod and located in the cylinder. The piston rod has a piston head connected to one end thereof. The piston head is movably in contact with the inside of the cylinder. A spring is mounted to the piston rod to provide a force to the piston rod. A cover is connected to the cylinder and has an opening. A locking member is a hollow tube and located in the cylinder. The piston rod extends through the locking member. A push tube extends through the locking member and communicates with the cylinder. The push tube has rib extending from the inside thereof so as to be engaged with the spring and the piston rod. A movable member is a hollow member and located in the push tube. The movable member communicates with the push tube. The movable member has an outlet on the top thereof. A hose is connected to the bottom of the movable member. The hose is inserted into the cylinder. A press head is connected to the push tube and communicates with the push tube. The press head is a hollow member and has a nozzle extending outward therefrom. A connection neck extends from the underside of the nozzle and is connected with the push tube. The movable member is located in the press head.

The primary object of the present invention is to provide a spray head assembly which has a check valve to seal the cylinder after distributing the liquid from the nozzle so as to prevent the spray head from leakage.

Another object of the present invention is to provide a spray head assembly wherein the interior of the spray head generates a suction force when the press head returns to its initial position so as to suck the liquid remained in the nozzle back.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
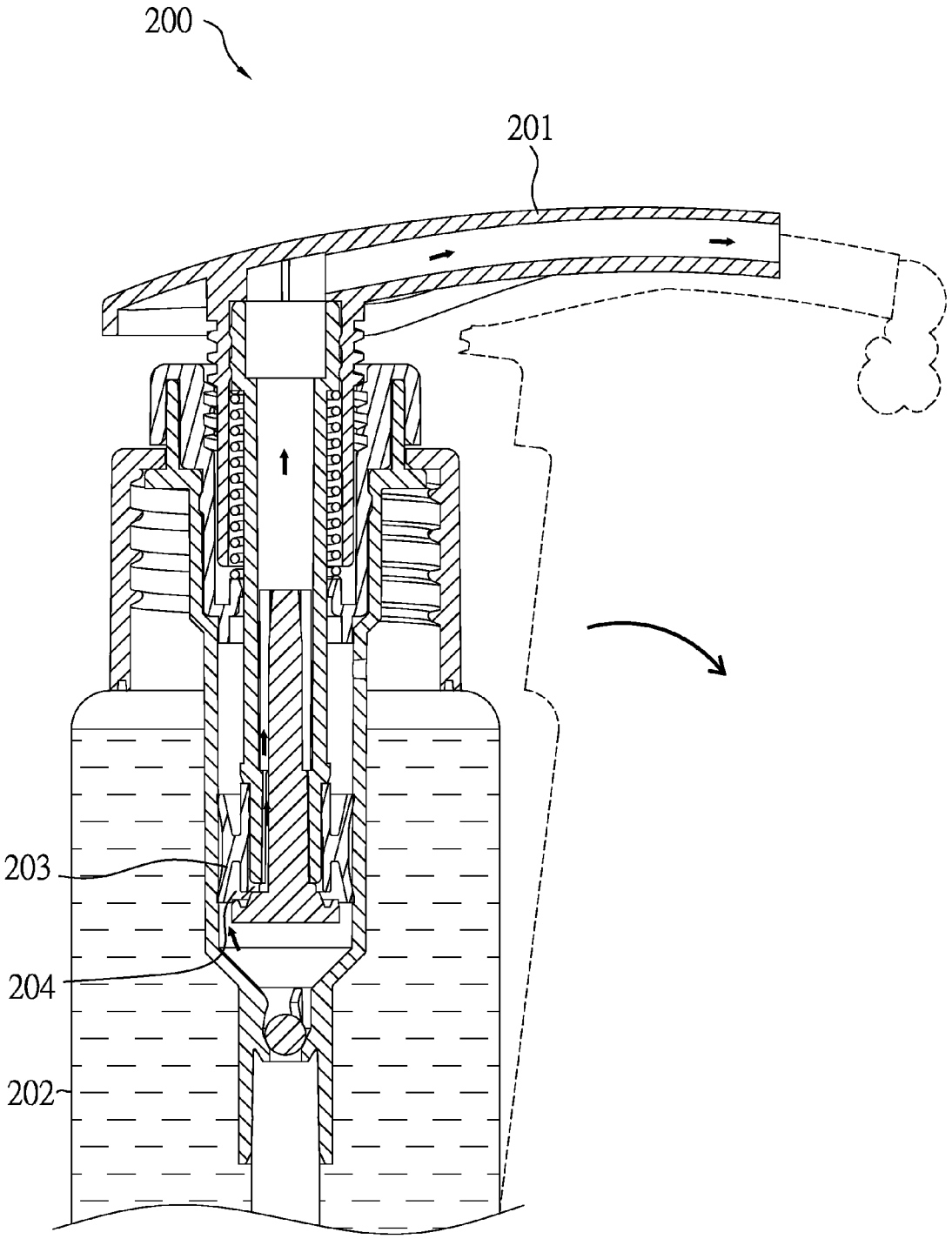
FIG.1 PRIOR ART
FIG. 1 is a cross sectional view of the conventional spray head assembly.
Figure 2A:
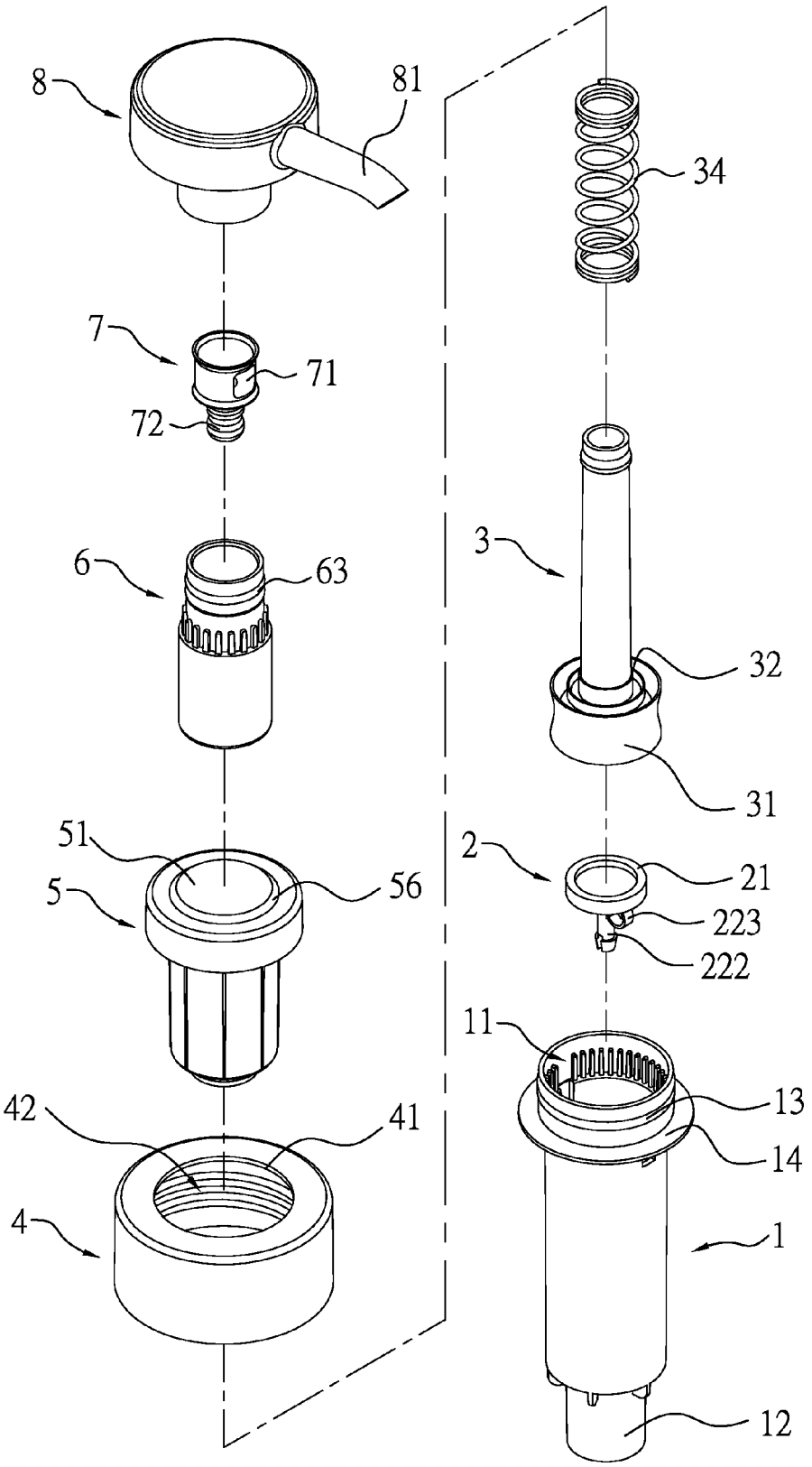
FIGS. 2A and 2B are exploded view and cross sectional view of the spray head assembly of the present invention.
Figure 2B:
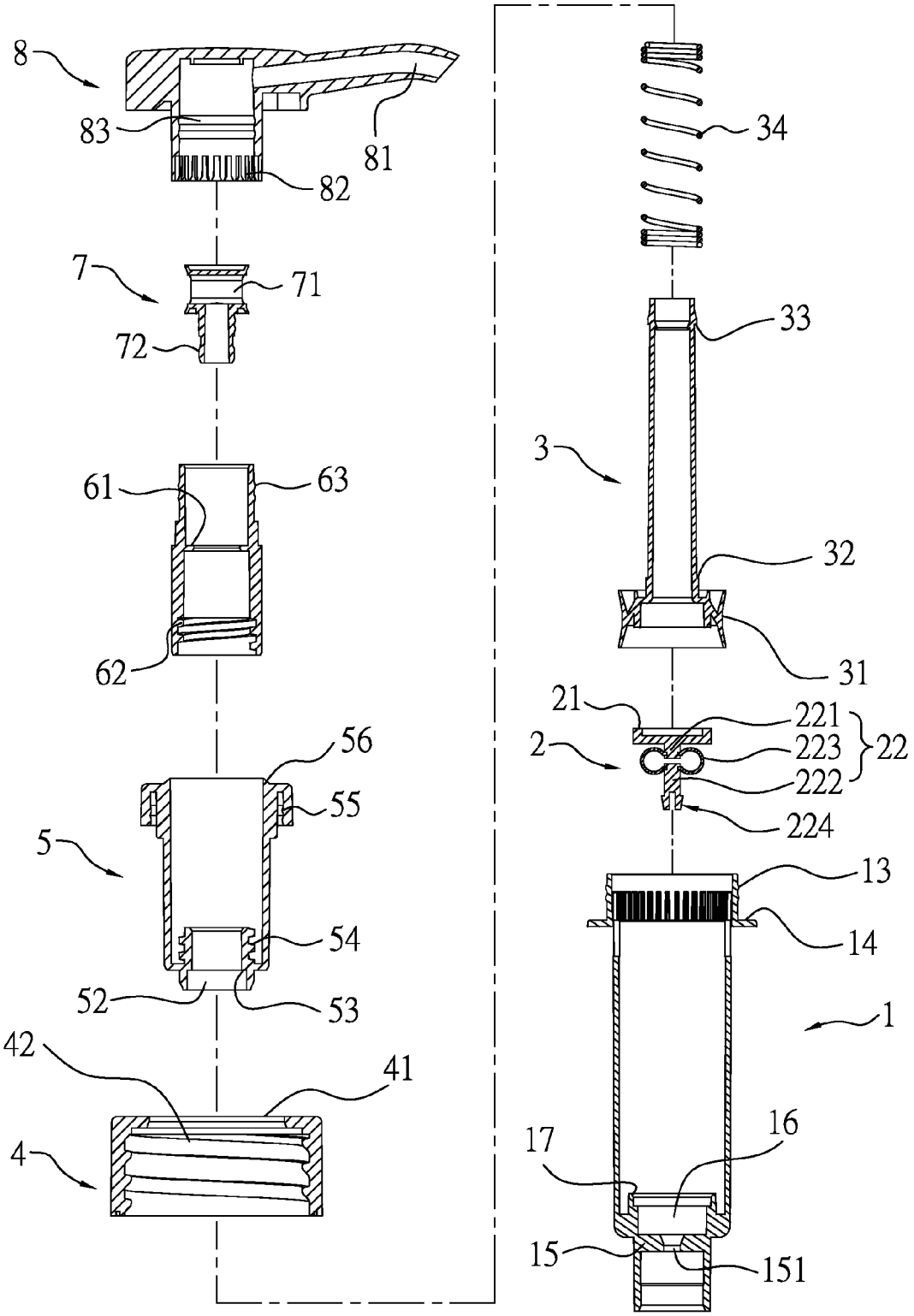

Referring to FIGS. 2A TO 2B, the spray head assembly of the present invention comprises a tubular cylinder 1 which has a connection end 11 and an inlet end 12. In this embodiment, the diameter of the inlet end 12 is smaller than the diameter of the cylinder 1. The connection end 11 has a connection portion 13 on the outer periphery thereof and a flange 14 extends from the outside of the connection end 11. A separation board 15 is transversely connected in the cylinder 1 and has a through hole 151 defined centrally therethrough. A space 16 is defined in the cylinder 1 and communicates with the through hole 151. An inlet path 17 is formed along the periphery of the space 16 and a check valve 2 is located in the space 16. The check valve 2 has a cap 21 which is a round cap and movably connected to the inlet path 17 which is opened and closed when the cap 21 is moved up and down. A check rod 22 extends from the underside of the cap 21. The check rod 22 comprises a first section 221 and a second section 222. A gap is formed between the first and second sections 221, 222. Multiple resilient members 223 are connected between the first and second sections 221, 222 so as to hold the cap 21 to prevent the cap 21 from being separated from the inlet path 17. In this embodiment, the resilient members 223 are round members. The second section 222 extends through the through hole 151. The second section 222 has a tapered face 224 to be engaged with the through hole 151 so that the second section 222 does not separate from the through hole 151. A piston rod 3 is a hollow rod and located in the cylinder 1. The piston rod 3 has a piston head 31 connected to one end thereof, in this embodiment, the piston head 31 is integrally formed with the piston rod 3. The piston head 31 is movably in contact with the inside of the cylinder 1. The piston rod 3 has a lower shoulder 32 and an upper shoulder 33 respectively connected to outsides of the two ends thereof. The lower shoulder 32 is located close to the piston head 31. A spring 34 is mounted to the piston rod 3 to provide a force to allow the piston rod 3 to move back to its initial position.

As shown in FIGS. 2A and 2B, a cover 4 is connected to the cylinder 1 and has an opening 41. The cover 4 has threads defined in the inside thereof so as to be connected with a bottle (not shown). The cover 4 is connected to the cylinder 1 until the cover 4 contacts the flange 14. The cover 4 is then connected with a locking member 5 which is a hollow tube and located in the cylinder 1. The piston rod 3 extends into the connection end 11 of the cylinder 1 and extends through the locking member 5. The locking member 5 has an exit 51 and an entrance 52. The entrance 52 has a restriction shoulder 53 extending from the inside thereof. The lower shoulder 32 of the piston rod 3 contacts the restriction shoulder 53 when the piston rod 3 extends through the locking member 5. The locking member 5 has outer threads 54 defined in the outside of a tubular portion extending from the entrance 52. The locking member 5 has a protrusion 55 extending from the outside of the top end thereof so as to be connected with the connection portion 13 of the cylinder 1. An inclined water-proof portion 56 extends from the periphery of the exit 51 and the inclined water-proof portion 56 has a certain height so as to prevent liquid from entering the cylinder 1 when in use to achieve the water-proof purpose of the spray head assembly. A push tube 6 is a hollow tube and extends through the exit 51 of the locking member 5, and then communicates with the cylinder 1. The push tube 6 has rib 61 extending from the inside thereof so as to be engaged with the spring 34 and the upper shoulder 33. The push tube 6 has inner threads 62 defined in the inside of the first end thereof. The inner threads 62 are connected to the outer threads 54 of the locking member 5. The push tube 6 has multiple first ridges 63 on the outside of the second end thereof. A movable member 7 is a hollow member and located in the push tube 6. The movable member 7 communicates with the push tube 6. The movable member 7 has an outlet 71 on the top thereof, and a hose 72 is connected to the bottom of the movable member 7. The hose 72 is inserted into the cylinder 1.

Figure 3:
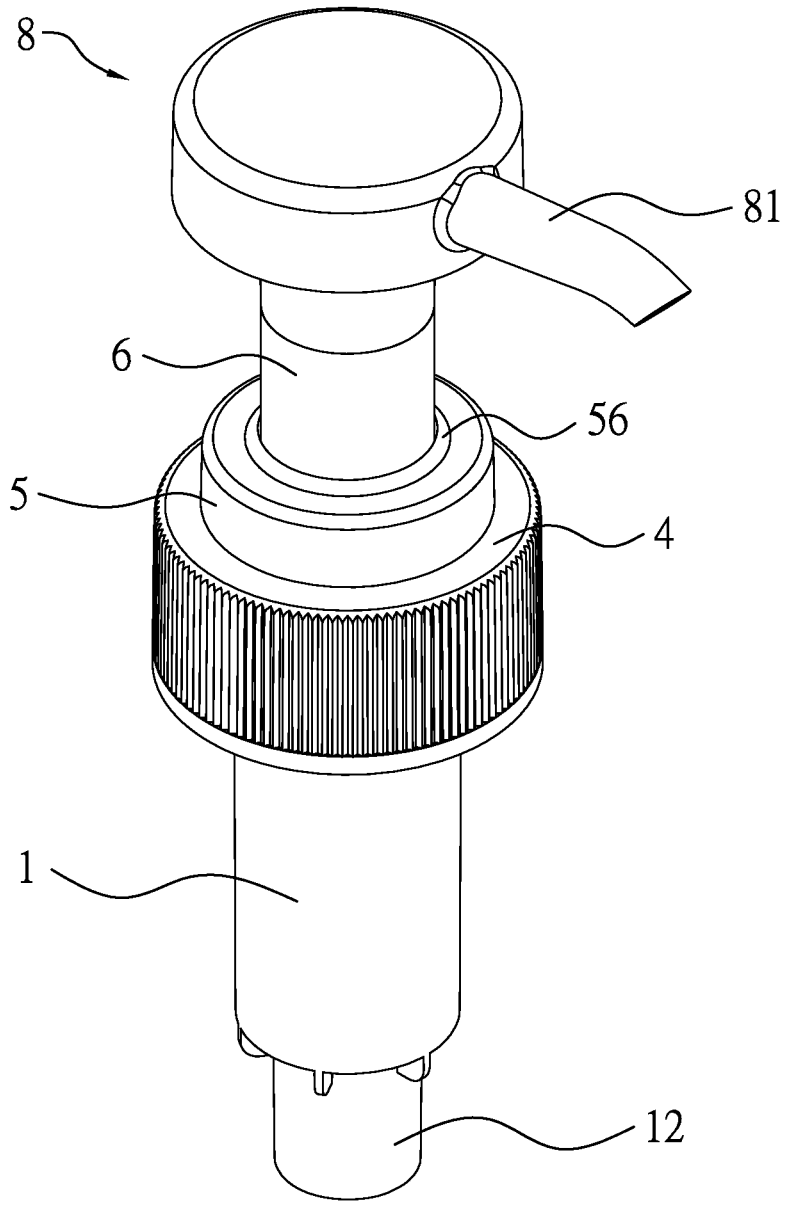
FIG. 3 is a perspective view to show the spray head assembly of the present invention.

Further referring to FIG. 3, a press head 8 is connected to the push tube 6 and communicates with the push tube 6. The press head 8 is a hollow member and has a nozzle 81 extending outward therefrom. A connection neck 82 extends from the underside of the nozzle 81 and is connected with the push tube 6. The movable member 7 is located in the press head 8. The connection neck 82 has multiple second ridges 83 formed on the inside thereof, and the first ridges 63 are connected to the second ridges 83 alternatively.

Figure 4A:
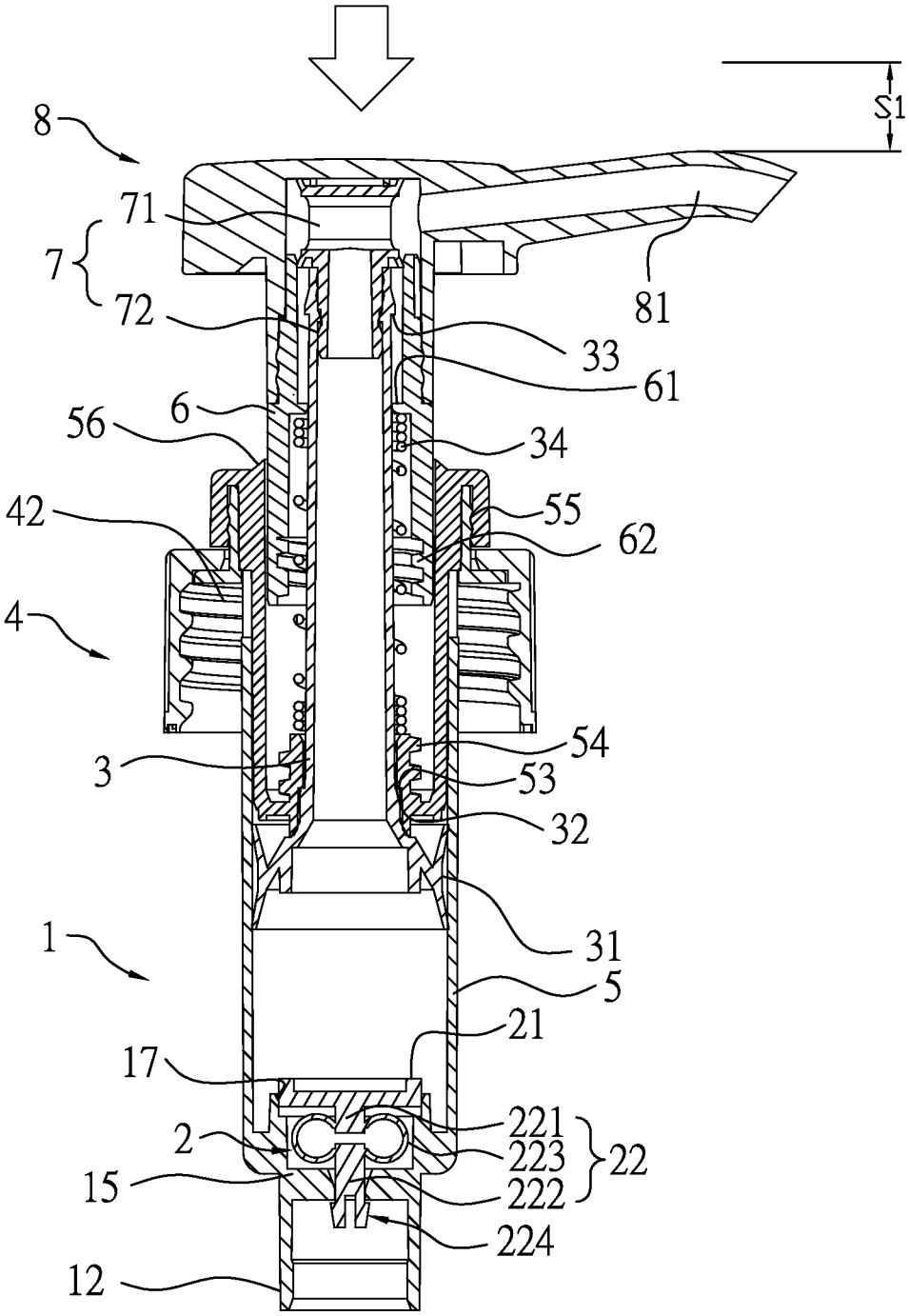
FIGS. 4A to 4C show the steps of operation of the spray head assembly of the present invention.
Figure 4B:
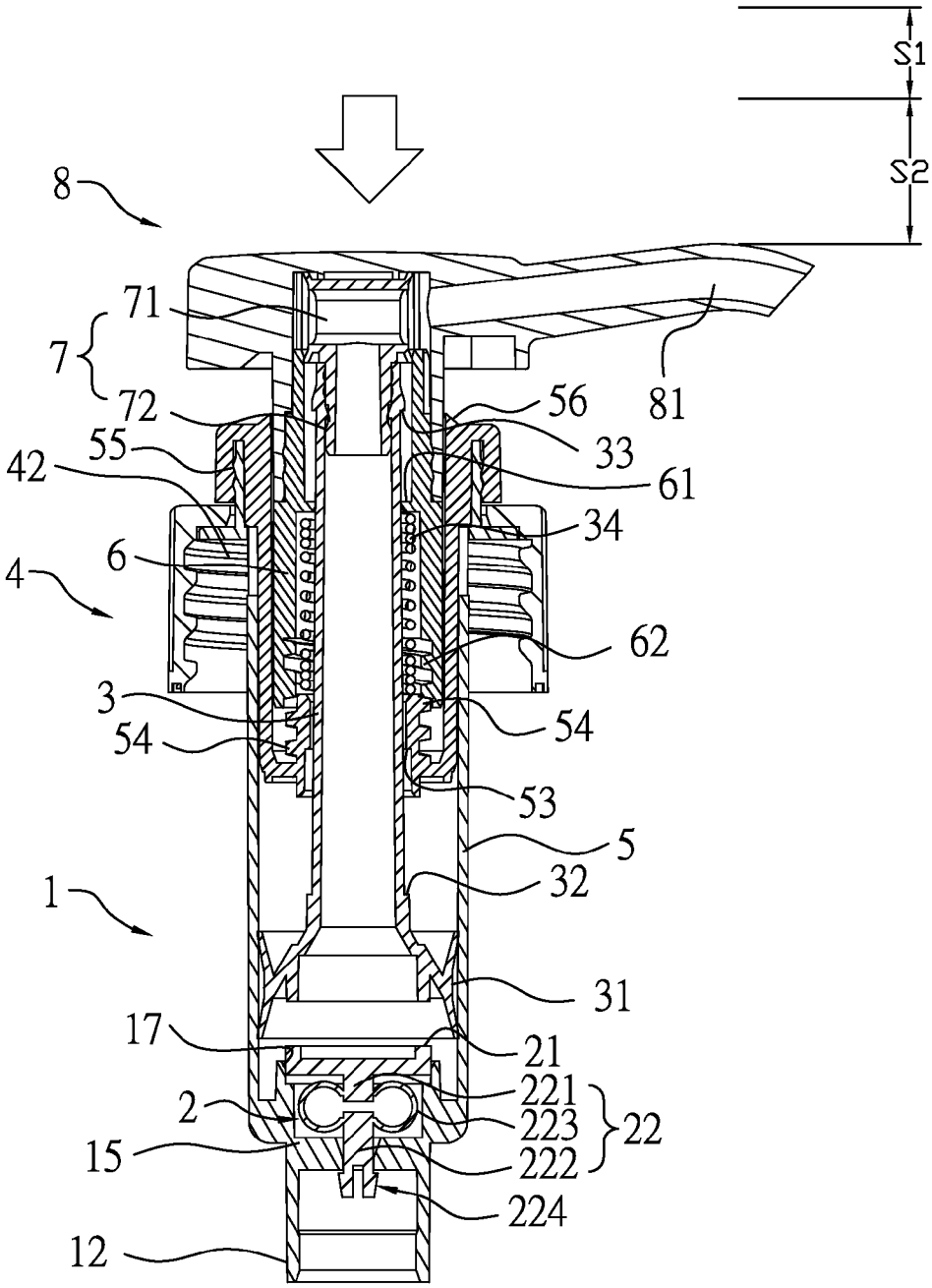
Figure 4C:
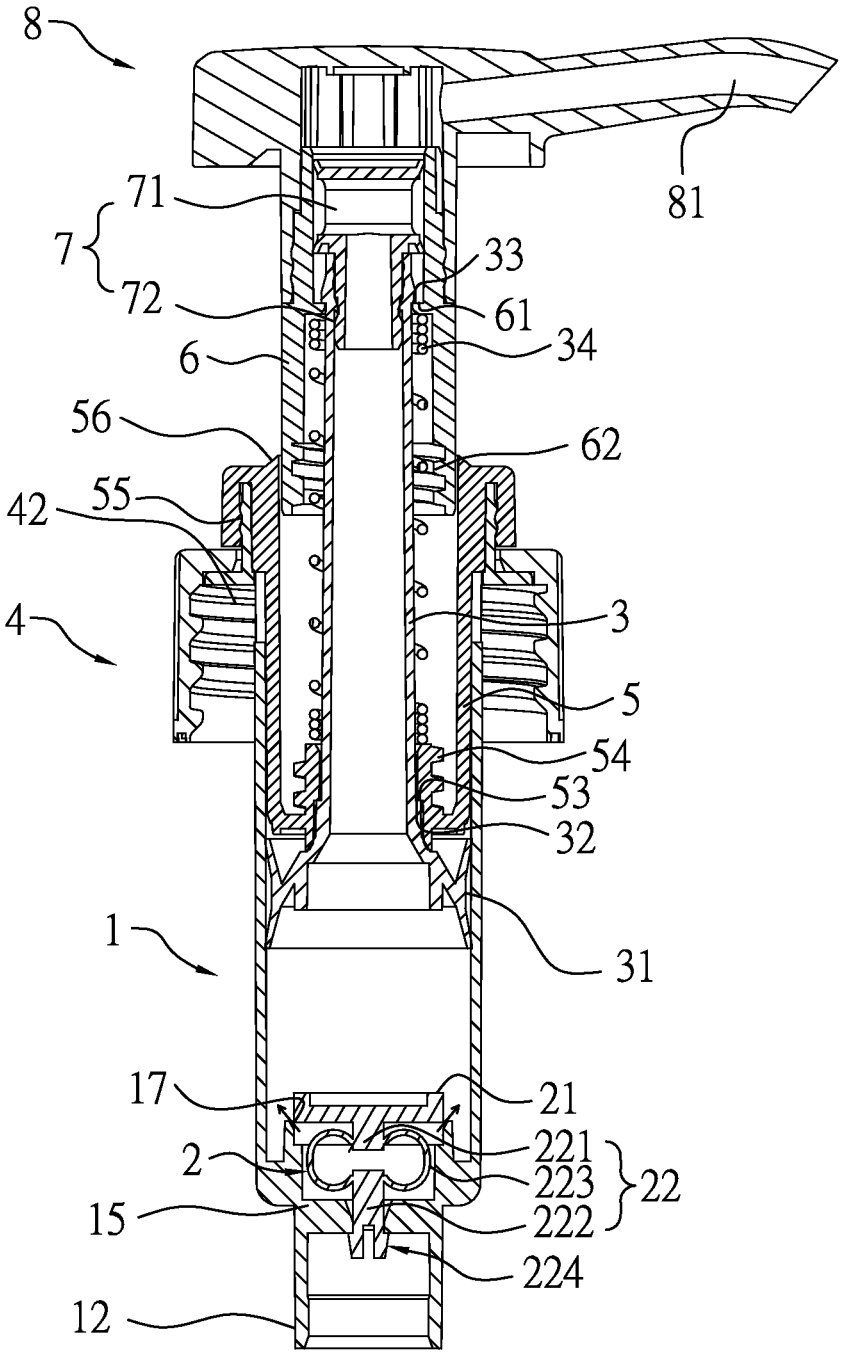

As shown in FIGS. 4A to 4C, when the press head 8 is pushed downward, the push tube 6 moves downward to the area S1 as shown in the drawings. The piston head 31 is remained stationary because of the friction with the inside of the cylinder 1. The downward movement of the press head 8 makes the outlet 71 of the movable member 7 be gradually opened and the outlet 71 communicates with the nozzle 81. When the press head 8 moves to the area S1 and contacts the top of the movable member 7, the outlet 71 is in alignment with the nozzle 81. The cap 21 is moved downward to seal the inlet path 17 because of the pressure. As shown in FIG. 4B, when the press head 8 enters into the area S2, the push tube 6 is driven by the press head 8 to compress the spring 34 until inner threads 62 of the push tube 6 are engaged with the outer threads 54 of the locking member 5. The air in the cylinder 1 ejects from the nozzle 81 because the piston head 31 compresses the space in the cylinder 1, so that the liquid is also ejected along with the air from the nozzle 81.

As shown in FIG. 4C, when the press head 8 returns, the push tube 6 moves upward by the force from the spring 34. The piston head 31 of the piston rod 3 is remained stationary because the friction. The press head 8 and the push tube 6 continuously move upward, the inclined ribs 61 of the push tube 6 are engaged with the upper shoulder 33 of the piston rod 3 so as to move the piston rod 3 upward until the lower shoulder 32 of the piston rod 3 contacts the restriction shoulder 53 of the locking member 5. The push tube 6 seals the outlet 71 of the movable member 7. The press head 8 completes the action of return. In this status, the room in the cylinder 1 increases and the liquid enters into the space 16 via the through hole 151 and pushes the cap 21 to gradually open the inlet path 17. Therefore, the liquid enters the cylinder 1 via the check valve 2 and is ready for next pump.

When the press head 8 returns the outlet 71 is gradually opened and generate suction force to suck the liquid remained in the nozzle 81 back so as to avoid the liquid remained in the nozzle 81 from flowing out from the nozzle 81.

Figure 5:
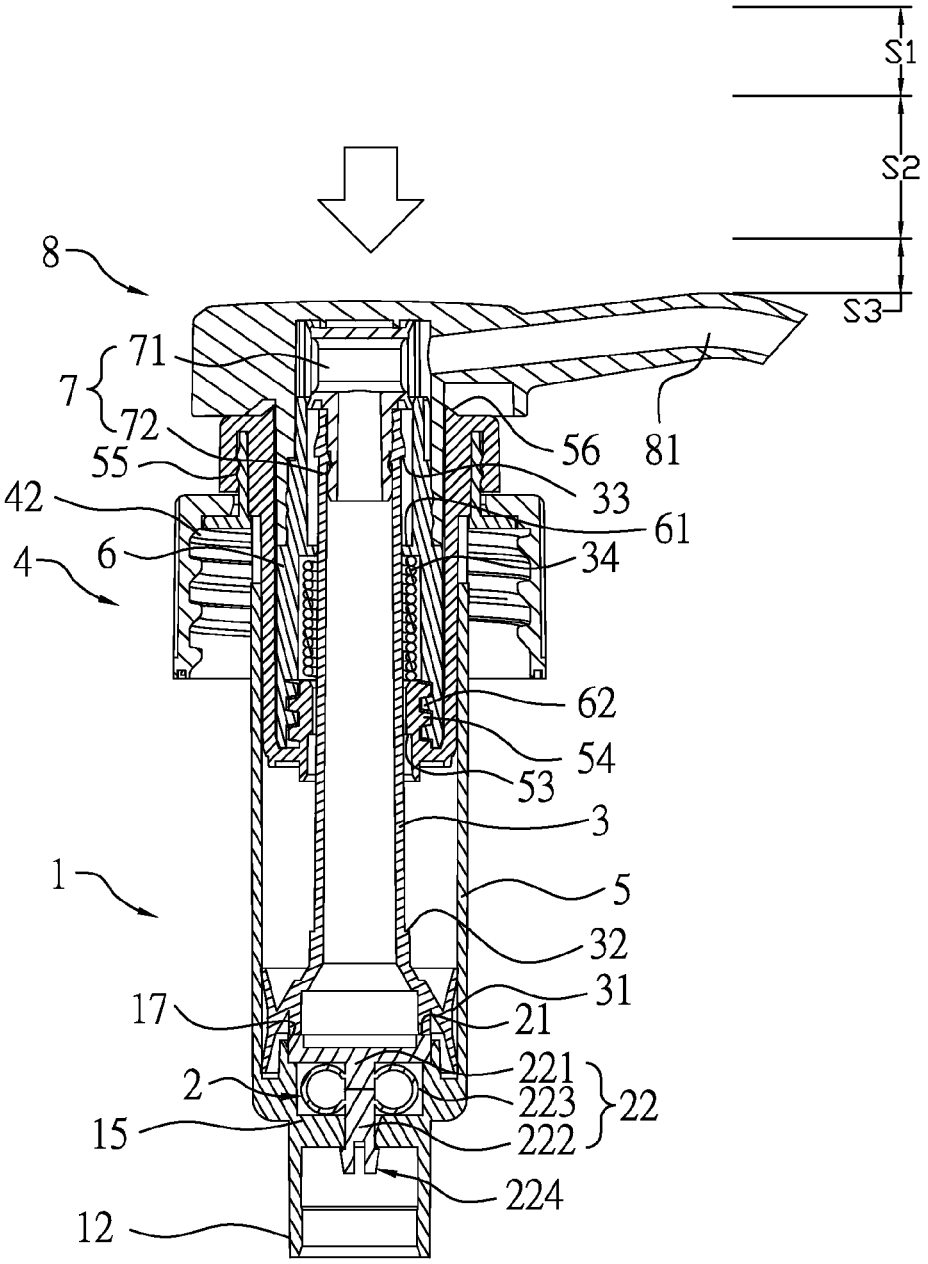
FIG. 5 shows another operation step of the spray head assembly of the present invention.

As shown in FIG. 5 which shows another embodiment of the present invention, when the press head 8 is pushed downward and passes through the areas S1 and S2, and the press head 8 is rotated clockwise to the area S3, the inner threads 62 of the push tube 6 are threadedly engaged with the outer threads 54 of the locking member 5. The check valve 2 is pushed by the piston rod 3, so that the space 16 in the cylinder 1 is sealed by the deformation of the resilient members 223 to prevent the liquid from flowing out.

Figure 6A:
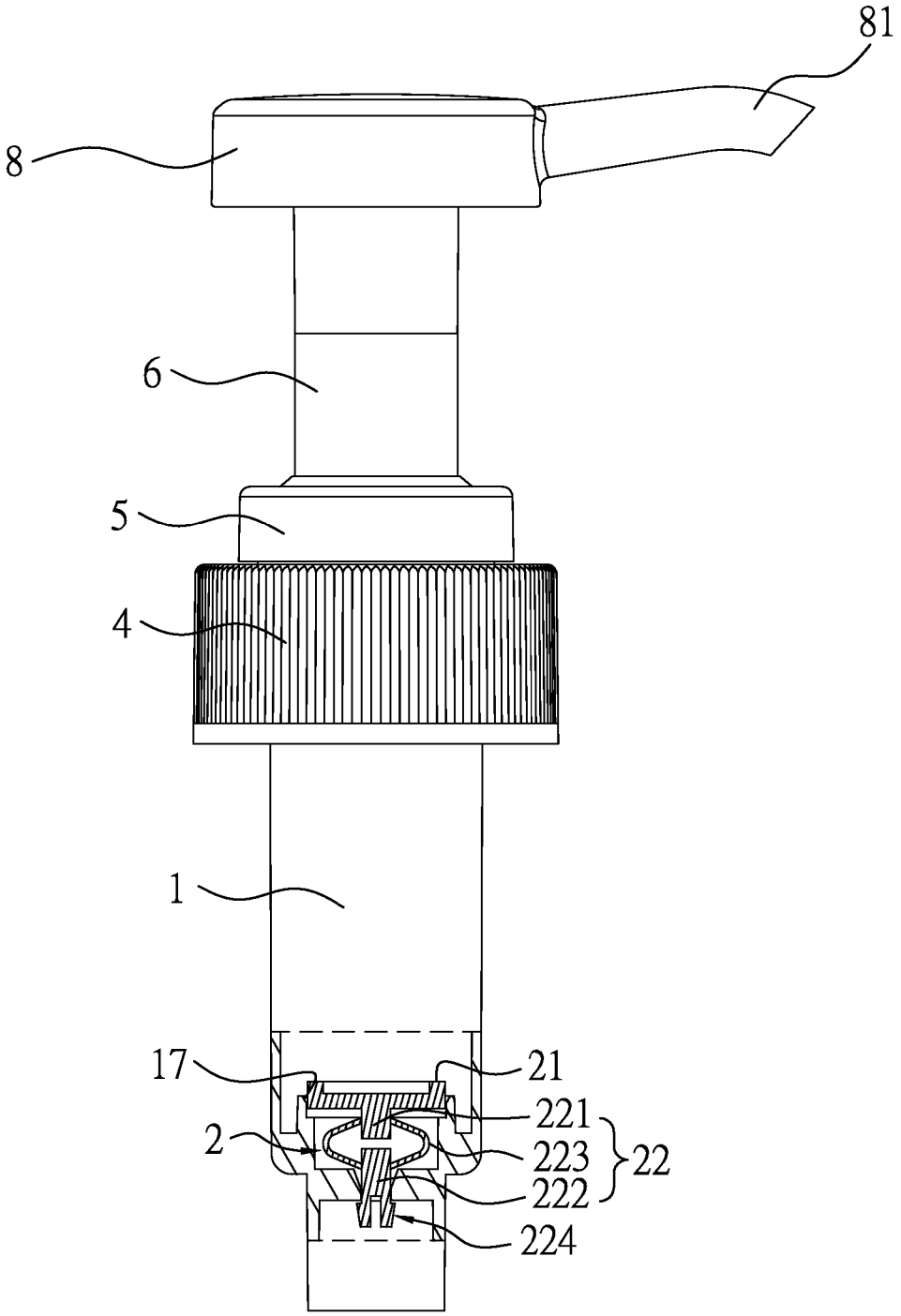
FIGS. 6A to 6C show the cross sectional views of another embodiment of the spray head assembly of the present invention.
Figure 6B:
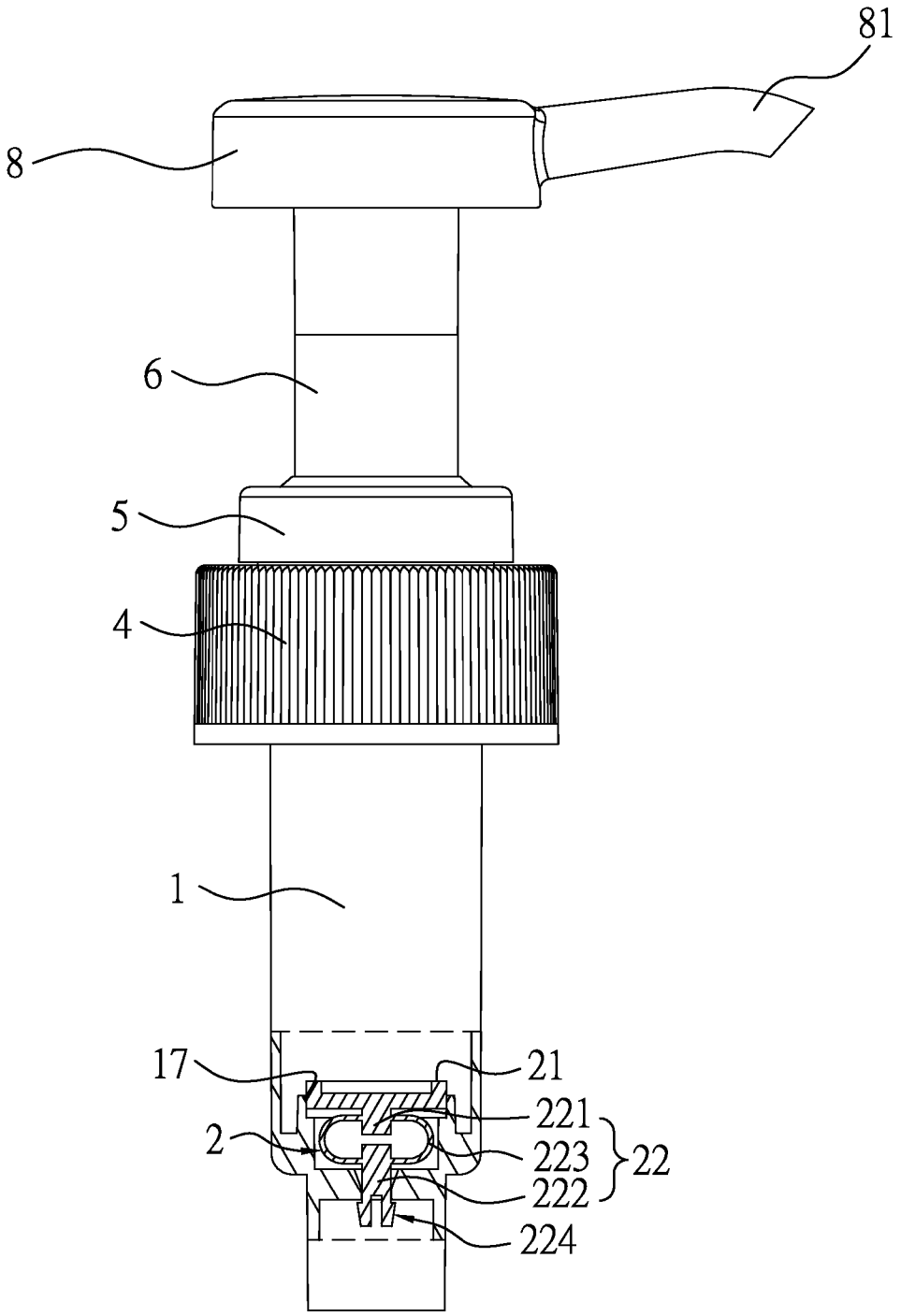
Figure 6C:
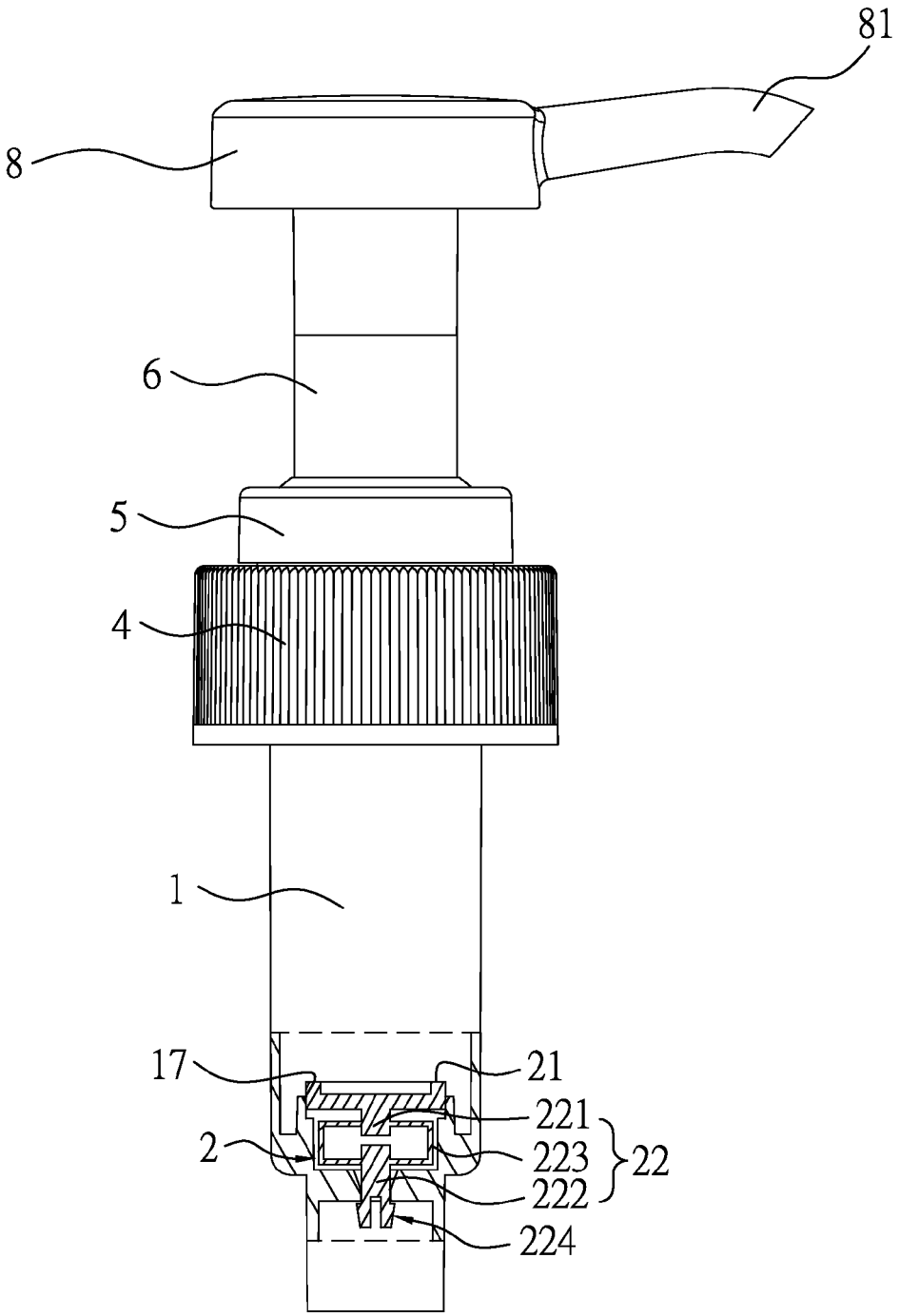
Figure 7:
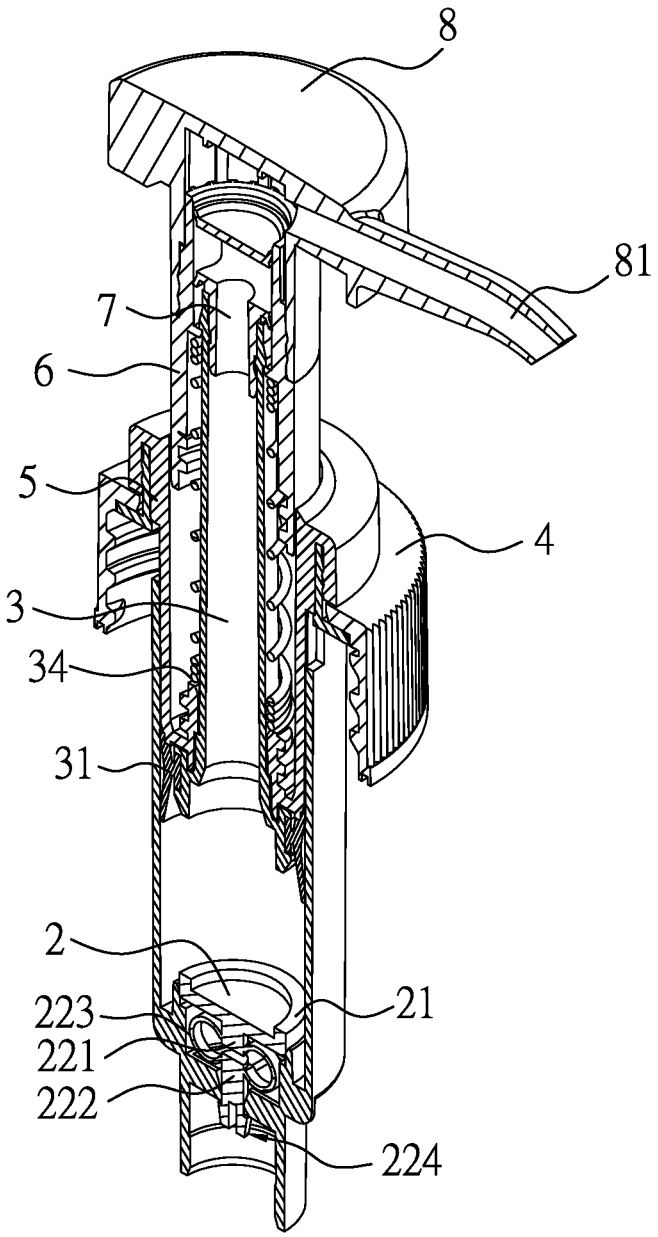
FIG. 7 shows the cross sectional views of yet another embodiment of the spray head assembly of the present invention.

As shown in FIGS. 6A to 6C, which show yet another embodiment of the present invention, wherein the resilient members 223 can be V-shaped as shown in FIG. 6A, semi-circular as shown in FIG. 6B, or rectangular as shown In FIG. 6C. As shown in FIG. 7, the piston head 31 on the top of the piston rod 3 can be integrally formed with the piston rod 3, or the piston head 31 is snapped to the piston rod 3.

While we have shown and described the embodiment in accordance with the present invention, it should be clear to those skilled in the art that further embodiments may be made without departing from the scope of the present invention.

What is claimed is:

1. A spray head assembly comprising:

a tubular cylinder, a separation board transversely connected in the cylinder and having a through hole, a space defined in the cylinder and communicating with the through hole;

a check valve located in the space, an inlet path being formed along a periphery of the space, the check valve having a cap and a check rod, the cap movably connected to the inlet path which is opened and closed when the cap is moved up and down, the check rod extending through the through hole;

a piston rod being a hollow rod and located in the cylinder, the piston rod having a piston head connected to one end thereof, the piston head being movably in contact with an inside of the cylinder;

a spring mounted to the piston rod to provide a force to the piston rod;

a cover connected to the cylinder and having an opening;

a locking member being a hollow tube and located in the cylinder, the piston rod extending through the locking member;

a push tube extending through the locking member and communicating with the cylinder, the push tube having rib extending from an inside thereof so as to be engaged with the spring and the piston rod;

a movable member being a hollow member and located in the push tube, the movable member communicating with the push tube, the movable member having an outlet on a top thereof, a hose connected to a bottom of the movable member, the hose inserted into the cylinder, and a press head connected to the push tube and communicating with the push tube, the press head being a hollow member and having a nozzle extending outward therefrom, a connection neck extending from an underside of the nozzle and connected with the push tube, the movable member is located in the press head.

2. The assembly as claimed in claim 1, wherein the cylinder has a connection end and an inlet end, a diameter of the inlet end is smaller than a diameter of the cylinder.

3. The assembly as claimed in claim 2, wherein the connection end has a connection portion on an outer periphery thereof and a flange extending from an outside of the connection end, the cover contacts the flange.

4. The assembly as claimed in claim 3, wherein the locking member has a protrusion extending from outside of a top end thereof so as to be connected with the connection portion of the cylinder.

5. The assembly as claimed in claim 1, wherein the check rod comprises a first section and a second section, a gap is formed between the first and second sections, multiple resilient members are connected between the first and second sections.

6. The assembly as claimed in claim 5, wherein a shaped of the resilient members is round, V-shaped, semi-circular or rectangular.

7. The assembly as claimed in claim 5, wherein the second section has a tapered face to be engaged with the through hole.

8. The assembly as claimed in claim 1, wherein the piston rod has a lower shoulder and an upper shoulder respectively connected to two ends thereof, the lower shoulder is located close to the piston head.

9. The assembly as claimed in claim 8, wherein the locking member has an exit and an entrance, the entrance has a restriction shoulder extending from an inside thereof, the lower shoulder of the piston rod contacts the restriction shoulder when the piston rod extends through the locking member.

10. The assembly as claimed in claim 9, wherein the locking member has outer threads defined in an outside of a tubular portion extending from the entrance.

11. The assembly as claimed in claim 10, wherein the push tube has inner threads defined in an inside of a first end thereof, the inner threads are connected to the outer threads of the locking member.

12. The assembly as claimed in claim 9, wherein an inclined water-proof portion extends from a periphery of the exit.

13. The assembly as claimed in claim 1, wherein the push tube has multiple first ridges on an outside of a second end thereof, the connection neck has multiple second ridges formed on an inside thereof, the first ridges are connected to the second ridges alternatively.

14. The assembly as claimed in claim 1, wherein the piston head is integrally formed with the piston rod.

15. The assembly as claimed in claim 1, wherein the piston head is snapped to the piston rod.

* * * * *